US009631394B2

(12) United States Patent
Grahn

(10) Patent No.: US 9,631,394 B2
(45) Date of Patent: Apr. 25, 2017

(54) TENT FRAME AND A TENT PROVIDED THEREWITH

(71) Applicant: Tentipi AB, Moskosel (SE)

(72) Inventor: Bengt Grahn, Sunne (SE)

(73) Assignee: Tentipi AB, Moskosel (SE)

( * ) Notice: Subject to any disclaimer, the term of this patent is extended or adjusted under 35 U.S.C. 154(b) by 0 days.

(21) Appl. No.: 15/025,330

(22) PCT Filed: Sep. 30, 2013

(86) PCT No.: PCT/SE2013/051129

§ 371 (c)(1),
(2) Date: Mar. 28, 2016

(87) PCT Pub. No.: WO2015/047142

PCT Pub. Date: Apr. 2, 2015

(65) Prior Publication Data

US 2016/0230409 A1 Aug. 11, 2016

(51) Int. Cl.

| | |
|---|---|
| ***E04H 15/24*** | (2006.01) |
| ***E04H 15/34*** | (2006.01) |
| ***E04H 15/44*** | (2006.01) |

(52) U.S. Cl.

CPC ..... *E04H 15/24* (2013.01); *E04H 15/34* (2013.01); *E04H 15/44* (2013.01)

(58) Field of Classification Search

CPC ..... E04H 15/24
USPC ..... 135/100, 908
See application file for complete search history.

(56) References Cited

U.S. PATENT DOCUMENTS

| | | | | | |
|---|---|---|---|---|---|
| 6,496 | A | * | 6/1849 | Dow | E04H 15/24 135/100 |
| 1,106,353 | A | * | 8/1914 | Adamec | E04H 9/14 135/100 |
| 1,270,701 | A | * | 6/1918 | Correll | E04H 15/46 135/100 |
| 1,415,482 | A | * | 5/1922 | Reed | E04H 15/006 135/100 |
| 2,663,306 | A | * | 12/1953 | Davis | E04H 15/24 135/100 |
| 2,842,145 | A | * | 7/1958 | Wilson, Jr. | E04H 15/006 135/100 |
| 3,039,478 | A | | 6/1962 | Timmons | |
| 3,042,052 | A | * | 7/1962 | Des Rosier | E04H 15/24 135/100 |

(Continued)

FOREIGN PATENT DOCUMENTS

| | | | |
|---|---|---|---|
| FR | 1159434 | A | 6/1958 |
| GB | 2061351 | A1 | 5/1981 |
| WO | 92/18729 | A1 | 10/1992 |

*Primary Examiner* — Noah Chandler Hawk

(74) *Attorney, Agent, or Firm* — Dilworth & Barrese, LLP

(57) ABSTRACT

A tent frame for carrying a tent cloth has at least five rods (2) each configured to have one end (3) resting on a ground, to extend from that end divergingly towards a top (4) of the tent and carry a tent cloth bearing outside thereon, as well as an arrangement configured to interconnect the rods to hold them in a determined mutual position. This arrangement has non-stretching elements (8) interconnecting every second rod in the circumferential direction of the frame as seen from above so that each rod will be internally passed by an element interconnecting the two adjacent rods on both sides thereof.

20 Claims, 5 Drawing Sheets

(56) References Cited

U.S. PATENT DOCUMENTS

| | | | | | |
|---|---|---|---|---|---|
| 3,258,020 | A | * | 6/1966 | McDonald | E04H 15/006 135/100 |
| 4,029,117 | A | * | 6/1977 | Rain | E04H 15/322 135/100 |
| 4,838,292 | A | | 6/1989 | Allen | |
| 4,838,293 | A | * | 6/1989 | Novak | E04H 15/24 135/100 |

* cited by examiner

TENT FRAME AND A TENT PROVIDED THEREWITH

TECHNICAL FIELD OF THE INVENTION AND BACKGROUND ART

The present invention relates to a tent frame for carrying a tent cloth comprising at least five rods each configured to have one end resting on a ground, to extend from that end divergingly towards a top of a said tent and to carry a tent cloth bearing outside thereon, and an arrangement configured to interconnect said rods so as to hold them in a determined mutual position, as well as a tent provided with such a tent frame.

Such a tent frame may be used for various types of tents, but the present invention is especially directed to such tent frames for tents having a substantially conical shape or at least the lower part thereof with the shape a lower part of cone, such as huts and tepees. Thus, "extend from that end divergingly" does not mean that said rods has to meet at the top of such a tent frame, but the upper ends of the rods may have a considerable mutual distance to each other, and the top of the tent may for instance be flat or make a considerable angle with respect to the extension of said rods.

The invention relates in particular but not exclusively to tent frames for the larger so-called "giant tent huts", which may have a top height and base diameter rather often in the region of 7 and 10 meters, respectively.

A tent frame of the type defined in the introduction is known through for example EP 0 579 663 D1. Although the tent frame disclosed in that publication is stable there is a desire to improve the stability of tent frames of this type for enabling a tent provided with such a tent frame to withstand strains from extremely strong winds, such as wind velocities of 28 meters/second or even higher.

SUMMARY OF THE INVENTION

The object of the present invention is to provide a tent frame of the type defined in the introduction being improved with respect to such tent frames already known with respect to the ability to making tent equipped thereby able to withstand strong winds.

This object is according to the invention obtained by providing such a tent frame with a said arrangement comprising non-stretching elements interconnecting every second said rod in the circumferential direction of said frame as seen from above so that each said rod will be internally passed by a said element interconnecting two adjacent rods on both sides thereof.

This feature of said arrangement combined with the feature that the arrangement is configured to interconnect said rods so as to hold them in determined mutual positions results in a tent frame being a very stable unit. When wind and snow apply strains on a rod of the tent frame this strain will be distributed to all other said rods, since the "star" formed by said non-stretching elements as seen from above results in a behaviour of these elements similar to an ordinary bicycle wheel with spokes overlapping each other as said elements and cooperating for preventing the rim from changing shape. Such a construction will be extremely strong and make it possible to obtain tents well able to withstand extremely high wind velocities, such as 28 meters/second.

According to an embodiment of the invention said arrangement comprises rigid members each interconnecting two of said rods and configured to keep said rods at a fixed mutual distance. The presence of such rigid members in combination with said non-stretching elements results in a tent frame being a very stable unit.

According to another embodiment of the invention each said rigid member extends between and interconnects adjacent said rods. Said non-stretching elements may then be flexible, since they do only have to withstand tension forces applied thereon when loads are applied on a rod forming an apex of a triangle having two sides formed by a said rigid member and the third side by a said element. Said non-stretching elements may then be formed by a wire, such as a steel wire.

According to another embodiment of the invention said non-stretching elements are rigid and forms said rigid members. This means that a stable construction may be formed without having any rigid member extending between and interconnecting adjacent said rods, but it is sufficient to have said non-stretching elements as said rigid members.

According to another embodiment of the invention said rigid members are provided with a first engaging member at each end and the rods have second engaging members arranged to enter into engagement with a first engaging members arranged on the corresponding rigid members when interconnecting rods by means of the rigid members, and each rigid member is releasable from and removable with respect to the rods by bringing the first and second engaging members out of their mutual engagement. This type of connecting said members to said rods is advantageous, since it means that the tent frame may easily be assembled to form a predetermined shape when pitching the tent and disassembled in a rational way when disassembling a tent.

According to another embodiment of the invention the tent frame comprises said elements interconnecting every second of said rods at at least one distance being the same or substantially the same to said one end of the those rods. It is preferred to have said non-stretching elements extending on at least one substantially the same height once a tent provided with such a tent frame is pitched. However, if the tent is rather high, such as for example 20 meters, it may be preferred to have such elements forming "stars" as seen from above at different levels, such as for instance a "star" at the heights of 3, 7, 11 and 15 meters. The same apply to said rigid members, which may be different or the same as said elements, and each of them does according to another embodiment of the invention connect to a said rod at at least one distance being the same or substantially the same to said one end of that rod.

According to another embodiment of the invention said arrangement is configured to be located at a height of 1.5-40 meters, 1.8-40 meters, 1.8-30 meters or 1.8-10 meters above a said ground onto which the tent frame is intended to rest. These are suitable heights for a said arrangement for obtaining the stability aimed at and allowing comfortable pitching, disassembling and use of a tent having such a tent frame. According to another embodiment of the invention the tent frame has at least 5, 5-15 or 7-12, such as 5, 6, 8 or 9, said rods. These are suitable numbers of rods for tents to which the present invention applies.

According to another embodiment of the invention the frame is configured to define at least a lower part, such as at least a ⅓, of a cone by said rods, and according to a further development of this embodiment the frame is configured to substantially define a cone or define a cone and form a frame of a substantially cone-shaped tent of a cone-shaped tent by said rods. The present invention is especially applicable to tent frames for these types of tents.

According to another embodiment of the invention the frame is configured to define a diameter of 4-50 meters, 7-20 meters or 8-15 meters on the ground by said one ends of said rods. A tent frame according to the invention is particularly well suited for such larger tents.

The invention also relates to a tent having a tent frame according to the present invention.

Further advantages as well as advantageous features of the invention will appear from the following description.

BRIEF DESCRIPTION OF THE DRAWINGS

With reference to the appended drawings, below follows a specific description of embodiments of the invention cited as examples.

In the drawings.

DETAILED DESCRIPTION OF EMBODIMENTS OF THE INVENTION

Figure 1:
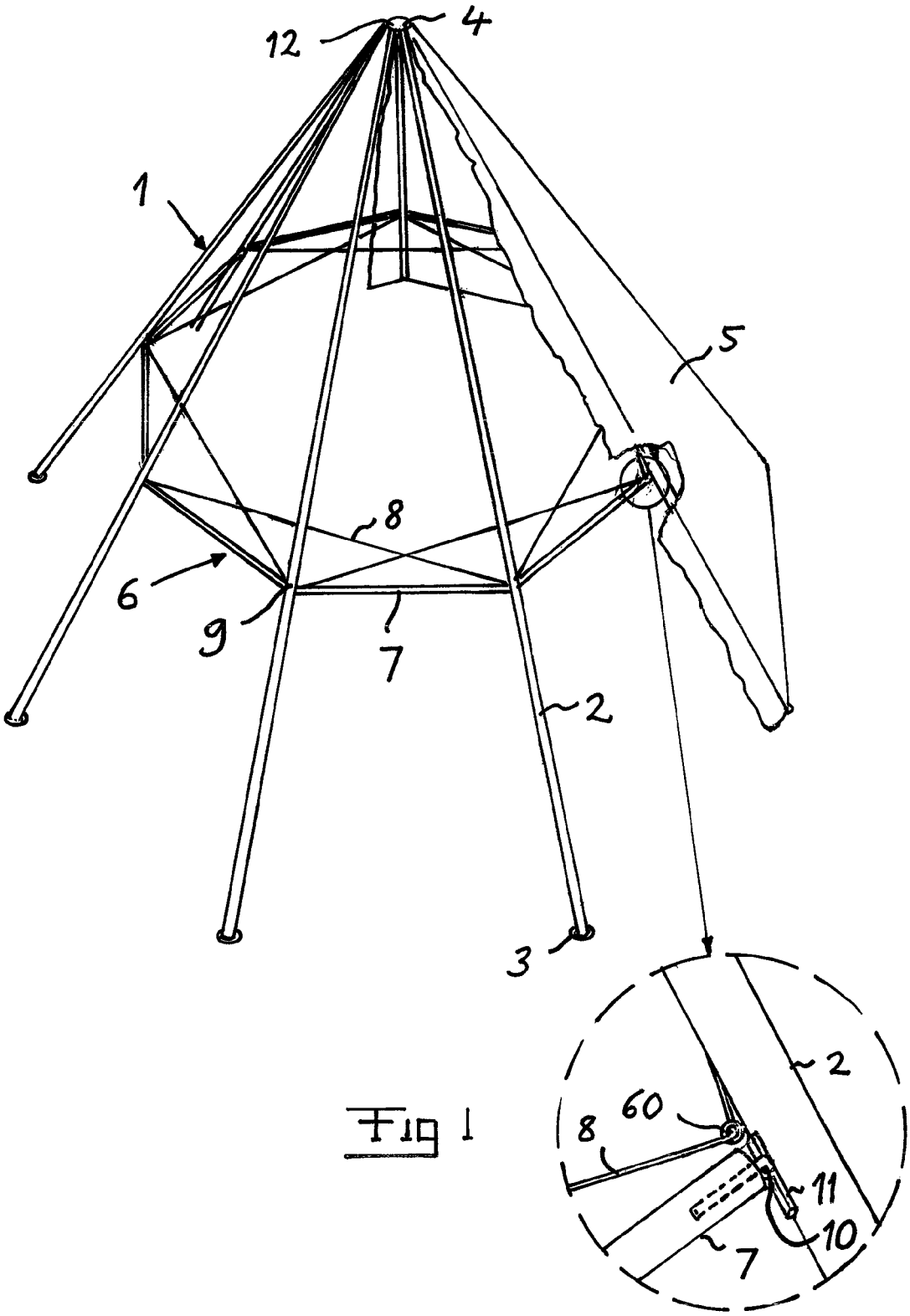
FIG. 1 is a simplified view obliquely from above of a tent frame according to a first embodiment of the invention showing a part of a tent cloth carried thereby.
Figure 2:
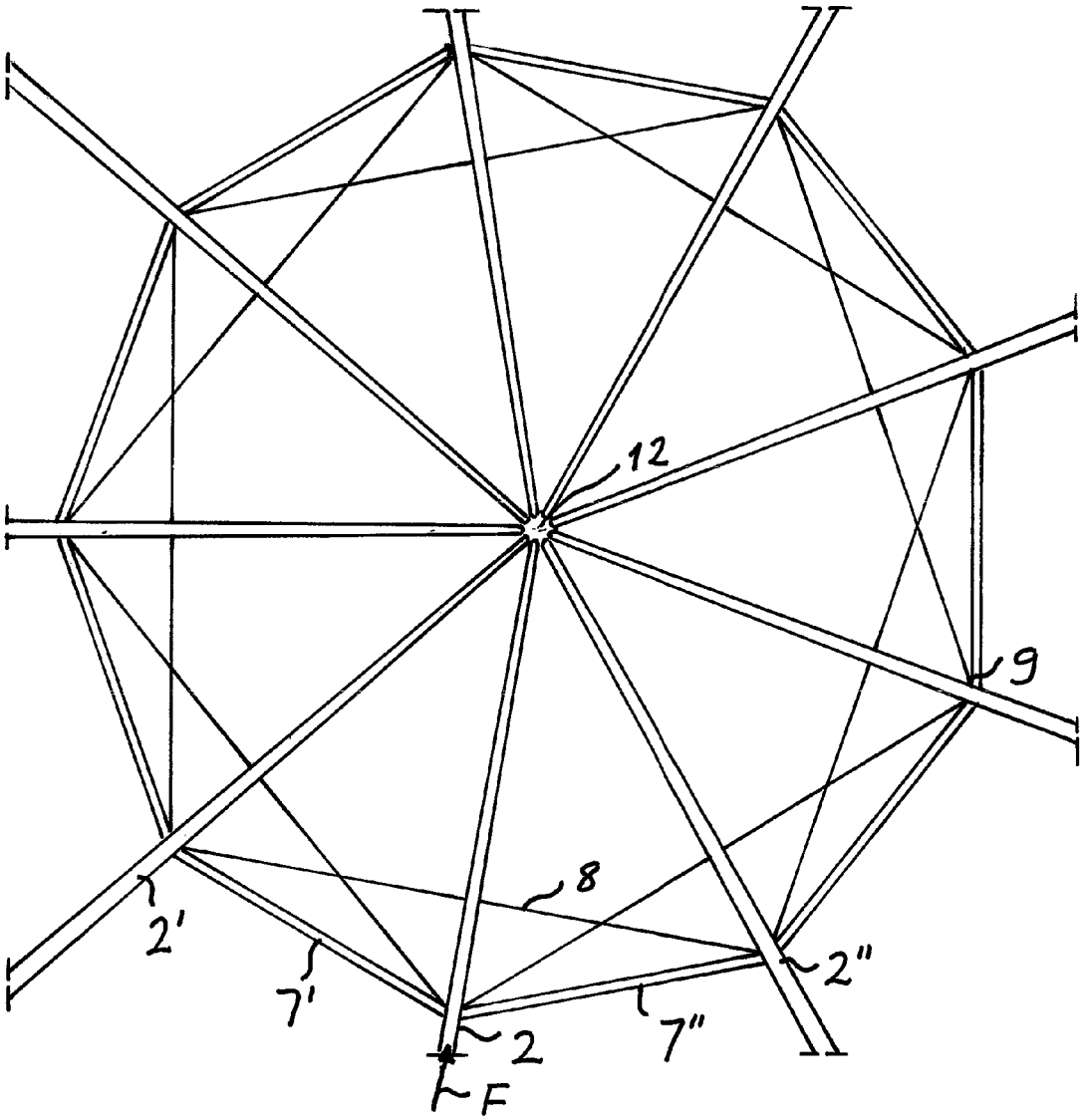
FIG. 2 is a schematic view from above of a tent frame shown in FIG. 1.

A tent frame according to a first embodiment of the invention is schematically shown in FIGS. 1 and 2 and comprises nine rods 2 each configured to have one end 3 resting on a ground, to extend from that end divergingly towards a top 4 thereof and to carry a tent cloth 5 bearing outside thereon. The rods 2 extend to form a frame of a substantially cone-shaped tent, such as a tepee.

The tent frame has an arrangement 6 located at a height at for example 2 meters above a said ground onto which the tent frame is intended to rest and configured to interconnect the rods 2 so as to hold them in a determined mutual position. This arrangement comprises rigid members 7, which each extends between and interconnects adjacent said rods 2. The arrangement also comprises non-stretching elements in the form of flexible wires 8 interconnecting every second said rod 2 in the circumferential direction of the frame as seen from above so that each said rod will be internally passed by a said element interconnecting the two adjacent rods on both sides thereof. Thus, this results in a "star"-like appearance of the design formed by said elements as seen from above as in FIG. 2 with a point 9 of said star connecting to each rod 2. The elements may be connected to the rods in any suitable way, such as being wound around each rod or introduced through fastening means, such as rings 60 as shown in FIG. 1, secured to each rod.

It is schematically indicated how the rigid members 7 are provided with a first engaging member 10 at each end and the rods have second engaging members 11 arranged to enter into engagement with a first engaging member arranged on the corresponding rigid member when interconnecting rods by means of the rigid members. Each rigid member is releasable from and removable with respect to the rods by bringing the first and second engaging members out of their mutual engagement.

The rods are at the top 4 connected to a top disc 12 or the like.

The function of the arrangement 6 will be as follows. Would a strong force be applied to a rod as illustrated by the arrow F in FIG. 2 by a strong wind and/or snow hitting the tent cloth carried thereby, the two rigid members 7', 7" connecting this rod to adjacent rods will ensure that the distance between the rod 2 and these rods 2', 2" may not be changed, so that the force F will try to increase the angle $\alpha$ of the apex formed by the two rigid members 7' and 7". However, the non-stretching element 8 interconnecting the two rods adjacent to the rod 2 will prevent any movement of the rod 2 and keep the tent frame very stable.

Figure 3:
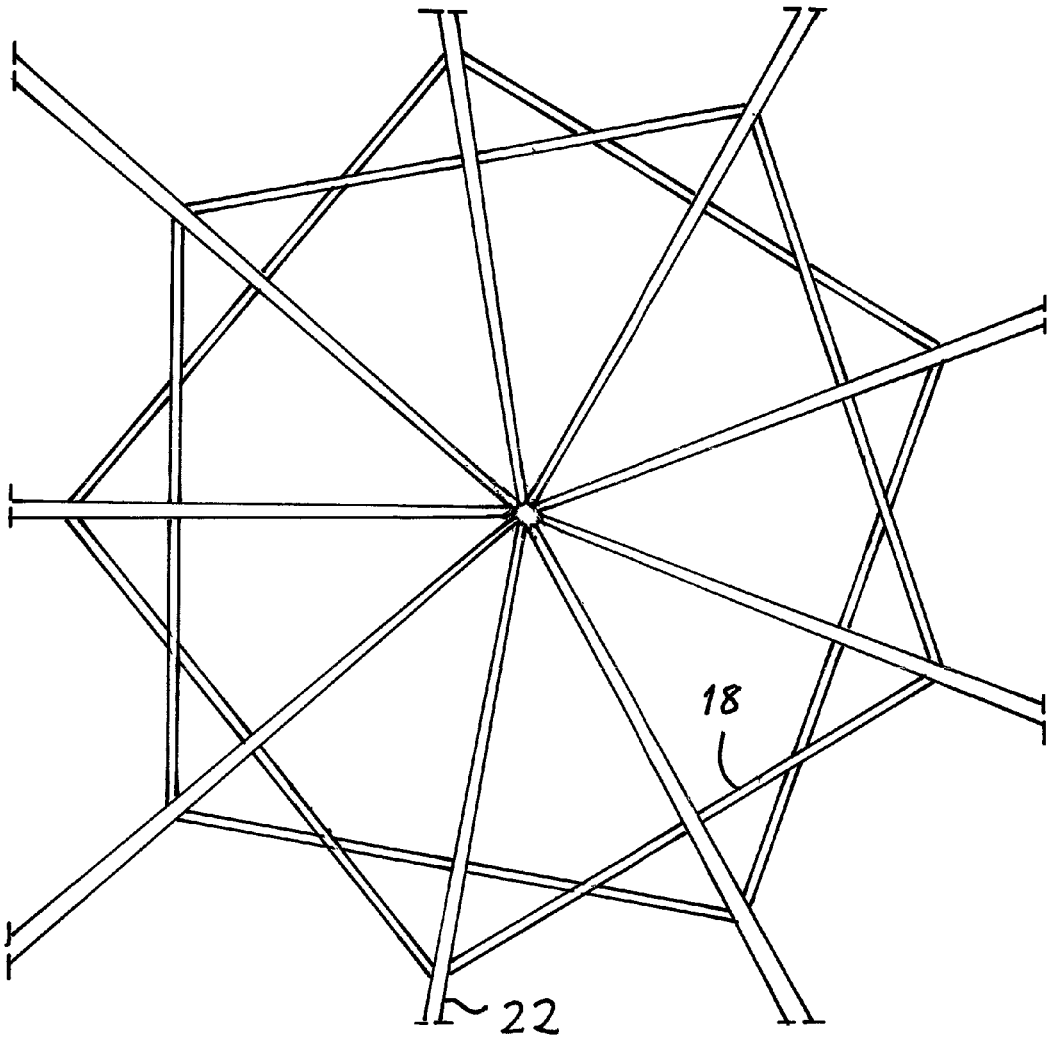
FIG. 3 is a view corresponding to FIG. 2 of a tent frame according to a second embodiment of the invention.

It is shown in FIG. 3 how the non-stretching elements 18 are formed by rigid members, which means that the stabilising function of said arrangement may be obtained without any rigid members interconnecting adjacent rods as in the embodiments shown in FIGS. 1 and 2.

Figure 4:
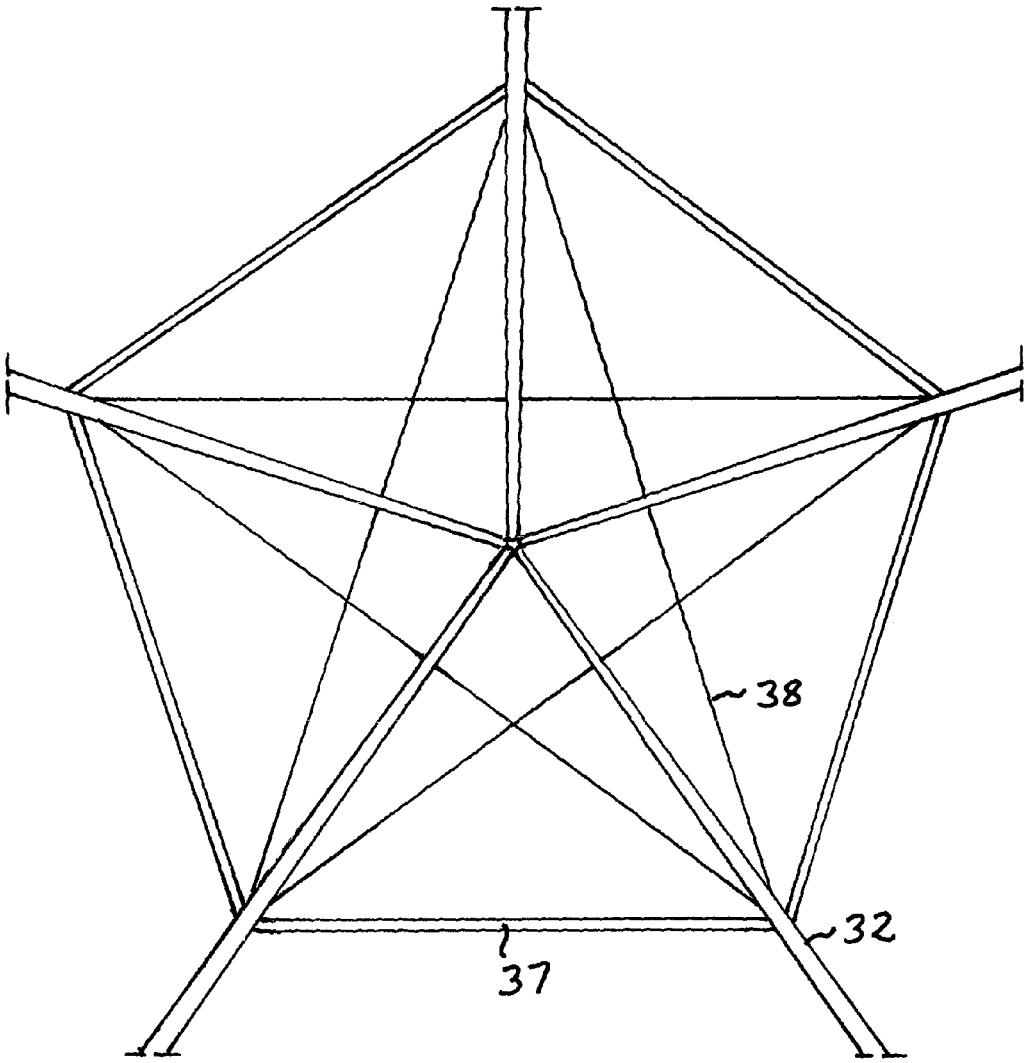
FIG. 4 is a view corresponding to FIG. 2 of a tent frame according to a third embodiment of the invention.

FIG. 4 illustrates schematically a tent frame according to an embodiment of the invention having only five said rods 32 provided with rigid members 37 interconnecting adjacent rods and flexible non-stretching elements 38 interconnecting every second said rod. This results in the same type of stabilising function of said arrangement formed by the rigid members and the non-stretching elements as for the embodiment shown in FIGS. 1 and 2.

Figure 5:
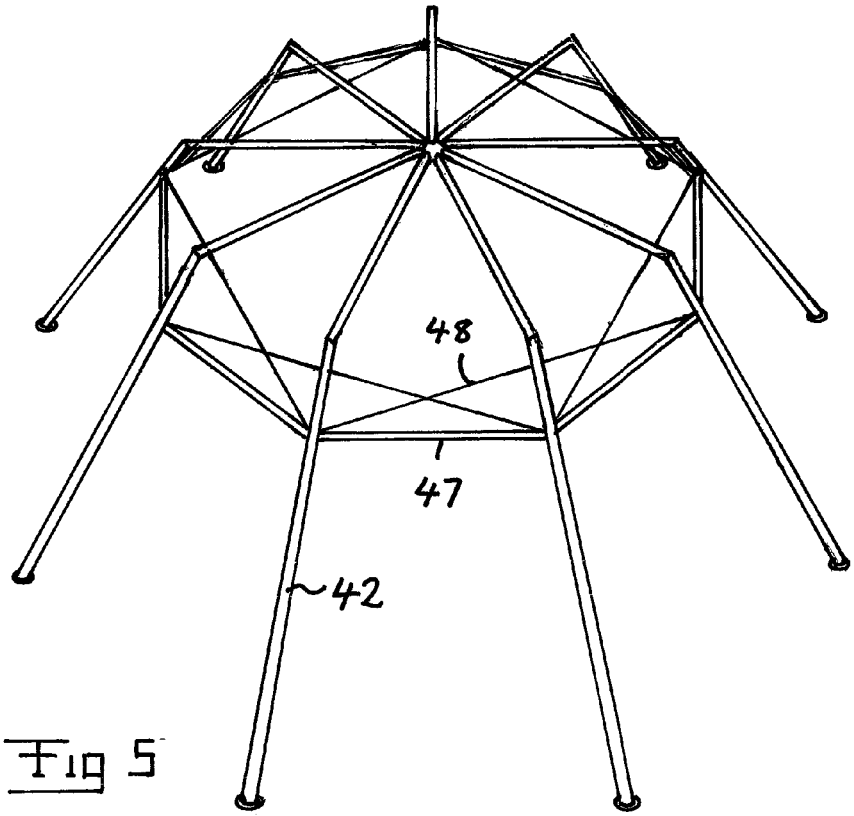
FIG. 5 is a view corresponding to FIG. 1 of a tent frame according to a fourth embodiment of the invention.

FIG. 5 illustrates a tent frame defining a lower part of a cone by the rods 42 thereof, so that it forms a part of a tent with a shape different from the cone by having another top, such as a substantially flat top. The rigid members 47 and the non-stretching elements 48 are arranged as in the embodiment shown in FIG. 1.

Figure 6:
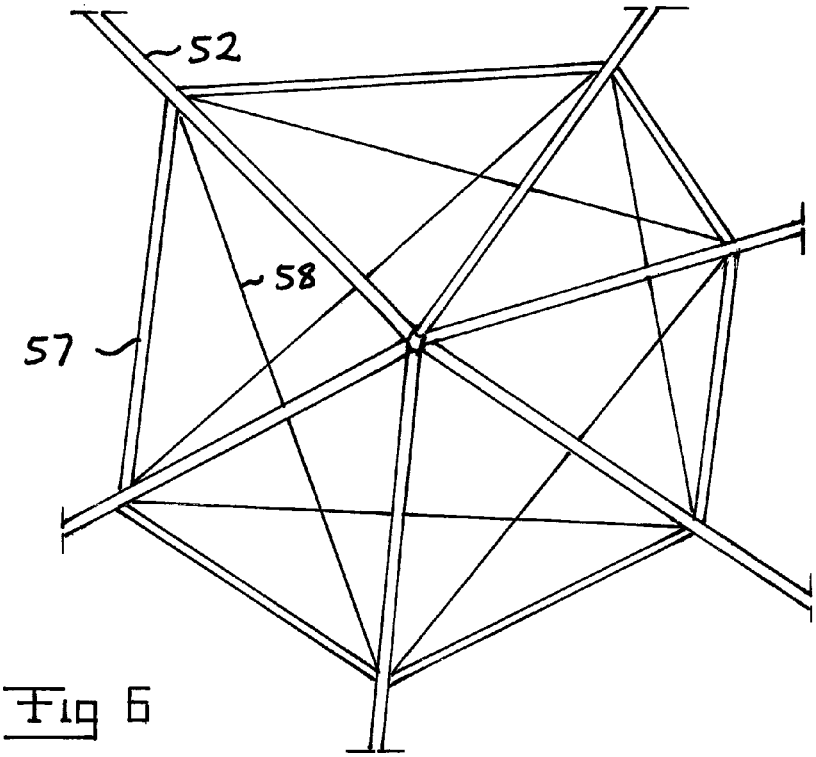
FIG. 6 is a view corresponding to FIG. 2 of a tent frame according to a fifth embodiment of the invention.

Finally, FIG. 6 illustrates how a tent frame according to an embodiment of the invention may have the rods 52 thereof arranged at different distances to adjacent rods, which means that said arrangement has rigid members 57 of different lengths and also non-stretching elements 58 of different lengths.

The invention is of course not in any way restricted to the embodiments described above, but many possibilities to modifications thereof would be apparent to a person skilled in the art without departing from the scope of the invention as defined in the appended claims.

The word "interconnect" as used in claim 1 in the expression "arrangement configured to interconnect said rods" is to be interpreted broadly and also comprises an indirect interconnection of said rods, such as by rigid members diverging out from a centre piece to each rod then being interconnected by means of such members secured to the same centre piece.

Each rod may be formed by a plurality of rod pieces connecting to each other for forming a long rod. These pieces are then preferably, but not necessarily, of aluminium. It is then possible to have one said "star" of non-stretching elements connected to each said rod piece for having stabilising "stars" at different levels of the tent. The "stars" are located at heights being correct with respect to the most sensitive spots of the tent frame.

The invention claimed is:

1. A tent frame for carrying a tent cloth (5) comprising at least five rods (2, 22, 32, 42, 52) each configured to have one end (3) resting on a ground, to extend from that end convergently towards a top (4) of said tent and secured together in a top region of the tent to carry a tent cloth bearing outside thereon, and an arrangement (6) configured to interconnect said rods to hold them in a determined mutual position, wherein said arrangement comprises non-stretching elements (8, 18, 38, 48, 58) interconnecting every second rod in the circumferential direction of said frame as seen from above such that each said rod is internally passed by and spaced from an element interconnecting the two adjacent rods (2, 22, 32, 42, 52) on both sides thereof.

2. A tent frame according to claim 1, wherein said arrangement comprises rigid members (7, 18, 37, 47, 57) each interconnecting two of said rods and configured to keep said rods at a fixed mutual distance.

3. A tent frame according to claim 2, wherein each said rigid member (7, 37, 47, 57) extends between and interconnects adjacent rods.

4. A tent frame according to claim 3, wherein said non-stretching elements (8, 38, 48, 58) are flexible.

5. A tent frame according to claim 4, wherein it comprises said non-stretching elements (8, 38, 48, 58) formed by a wire, such as a steel wire.

6. A tent frame according to claim 5, wherein said rigid members (7) are provided with a first engaging member (10) at each end and the rods (2) have second engaging members (11) arranged to enter into engagement with first engaging members arranged on the corresponding rigid members when interconnecting rods by the rigid members, and each rigid member (7) is releasable from and removable with respect to the rods by bringing the first and second engaging members out of their mutual engagement.

7. A tent frame according to claim 4, wherein said rigid members (7) are provided with a first engaging member (10) at each end and the rods (2) have second engaging members (11) arranged to enter into engagement with first engaging members arranged on the corresponding rigid members when interconnecting rods by the rigid members, and each rigid member (7) is releasable from and removable with respect to the rods by bringing the first and second engaging members out of their mutual engagement.

8. A tent frame according to claim 3, wherein said rigid members (7) are provided with a first engaging member (10) at each end and the rods (2) have second engaging members (11) arranged to enter into engagement with first engaging members arranged on the corresponding rigid members when interconnecting rods by the rigid members, and each rigid member (7) is releasable from and removable with respect to the rods by bringing the first and second engaging members out of their mutual engagement.

9. A tent frame according to claim 2, wherein said non-stretching elements (18) are rigid and form said rigid members.

10. A tent frame according to claim 1, wherein said rigid members (7) are provided with a first engaging member (10) at each end and the rods (2) have second engaging members (11) arranged to enter into engagement with first engaging members arranged on the corresponding rigid members when interconnecting rods by the rigid members, and each rigid member (7) is releasable from and removable with respect to the rods by bringing the first and second engaging members out of their mutual engagement.

11. A tent frame according to claim 2, wherein said rigid members (7, 18, 37, 47, 57) connecting to a rod at least at one distance are all located at the same or substantially the same height of said rods (2, 22, 32, 42, 52) from the bottom ends (3) thereof.

12. A tent frame according to claim 1, wherein said elements (8, 18, 38, 48, 58) interconnecting every second of said rods at least at one distance are all located at the same or substantially the same height of said rods (2, 22, 32, 42, 52) from the bottom ends (3) thereof.

13. A tent frame according to claim 1, wherein said arrangement (6) is configured to be located at a height of 1.5-40 meters, 1.8-40 meters, 1.8-30 or 1.8-10 meters above a ground onto which the tent frame is intended to rest.

14. A tent frame according to claim 1, wherein it has at least 5, 5-15 or 7-12, such as 5, 6, 8 or 9, of said rods (2, 22, 32, 42, 52).

15. A tent frame according to claim 1, wherein the frame is configured to define at least a lower part, such as at least a ⅓, of a cone by said rods.

16. A tent frame according to claim 15, wherein the frame (1) is configured to substantially define a cone or define a cone and form a frame of a substantially cone-shaped tent or a cone-shaped tent by said rods.

17. A tent frame according to claim 15, wherein the frame (1) is configured to define a diameter of 4-50 meters, 7-20 meters or 8-15 meters on the ground by said one-ends of said rods.

18. A tent having a tent frame according to claim 1.

19. A tent frame according to claim 1, wherein said rods (2, 22, 32, 42, 52) are all connected to one another at the top (4) thereof.

20. A tent frame according to claim 19, additionally comprising a disc (12) interconnecting all said rods (2, 22, 32, 42, 52) to one another at the top (4) thereof.

* * * * *